United States Patent [19]

Furuya

[11] Patent Number: 4,787,119

[45] Date of Patent: Nov. 29, 1988

[54] SUPPORT STRUCTURE FOR ENGAGING OPENING AND CLOSING UNITS TO TRACK

[76] Inventor: Makoto Furuya, 5, Kandasakumacho 4-chome, Chiyoda-ku, Tokyo, Japan, 101

[21] Appl. No.: 89,876

[22] Filed: Aug. 27, 1987

[30] Foreign Application Priority Data

Aug. 29, 1986 [JP] Japan ..... 61-202831

[51] Int. Cl.[4] ..... E06B 3/46; E05D 15/10

[52] U.S. Cl. ..... 16/102; 16/89; 49/127

[58] Field of Search ..... 16/87 R, 87 B, 87.4 R, 16/89, 95 R, 95 W, 95 D, 95 DW, 99, 102, 106; 160/36; 49/127

[56] References Cited

U.S. PATENT DOCUMENTS

| | | | |
|---|---|---|---|
| 1,886,105 | 11/1932 | Julin | 49/127 X |
| 2,573,236 | 10/1951 | Whittit | 16/87 R |
| 3,118,168 | 1/1964 | Arcuri | 16/87 R |
| 3,334,375 | 8/1967 | Hubbard | 49/127 X |

FOREIGN PATENT DOCUMENTS

| | | | |
|---|---|---|---|
| 691381 | 5/1940 | Fed. Rep. of Germany | 49/127 |
| 55-61683 | 5/1980 | Japan . | |
| 55-70587 | 5/1980 | Japan . | |
| 60-170483 | 11/1985 | Japan . | |

*Primary Examiner*—Nicholas P. Godici

*Assistant Examiner*—J. Reed Batten, Jr.

*Attorney, Agent, or Firm*—Armstrong, Nikaido, Marmelstein & Kubovcik

[57] ABSTRACT

A support structure for engaging opening and closing units to a track, wherein a support structure 1 comprises a support main body which is secured to each of a plurality of opening/closing units that move along an opening/closing section A of a predetermined length and a storing section B in contiguous with the section A, and which has oblique slidable contact sides each formed in parallel with each other at both ends of a horizontal plane thereof, side engagement members each formed in parallel along the side of each of the support main bodies for slidably engaging a plurality of adjacent support main bodies to each other when the main bodies are arranged in parallel with each other, a pulling engagement member integrally secured along one of the oblique slidable contact sides of the support main body and formed with an engaging groove and another pulling engagement member integrally secured to the other of the oblique slidable contact sides of the support main body at a position inside the blunt apex so as to be engageable in the engaging groove of the one pulling engagement member of an adjacent support main body. The slidable engagement members and pulling engagement members for adjacent structures are thus formed independently of each other.

3 Claims, 3 Drawing Sheets

SUPPORT STRUCTURE FOR ENGAGING OPENING AND CLOSING UNITS TO TRACK

BACKGROUND OF THE INVENTION

1. Technical Field

This invention concerns a support structure secured to the upper side or both of the upper and the lower sides of each of opening/closing units used for a sliding shutter, sliding partition, etc. for engaging a plurality of such units along a track while maintaining the connection between them.

More specifically, this invention relates to a support structure for opening and closing units, which comprises side engagement members served for the slidable engagement between the support structure of adjacent opening and closing units when a plurality of support structure are arranged in parallel with each other and pulling engagement members served for the connection between both of the ends of the support structures of adjacent opening/closing units when a plurality of support structures are arranged in series with each other, in which the side engagement members and the pulling engagement members are disposed independently.

2. Disclosure of the Prior Art

For closing and opening a predetermined section by a plurality of opening and closing units (hereinafter also referred to as opening/closing units) connected with each other, various types of devices have been known in which a plurality of opening/closing units are contained in parallel with each other in a storing section disposed at one end of the section to be closed and opened (hereinafter also referred to as an opening/closing section) when the opening/closing section is opened, whereas they are pulled out in a chain-like connection from the storing section when the opening/closing section is to be opened. However, such known devices involve respective drawbacks as below.

At first, Japanese Utility Model Application No. 58077/1984 (Utility Model Application Laying Open No. 170483/1985) discloses one of such devices. However, since the arm member for slidable engagement used for each of the opening/closing units is protruded sideway, the arm makes a hindrance upon containing a plurality of opening/closing units in the storing section. Thus, the opening/closing units are contained in parallel but with the forward (backward) ends thereof being displaced from each other to result in dead spaces at the forward (backward) ends in the storing section to take an unnecessary space.

Further, Japanese Patent Application No. 134880/1978 (Japanese Patent Application Laying Open No. 61683/1980) and Japanese Utility Model Application No. 154542/1978 (Japanese Utility Model Application Laying Open No. 70587/1985), etc. disclose such structures that each of the opening/closing units is moved sideway in the storing section in the direction perpendicular to the opening/closing section, thereby decreasing the dead space. However, a coil spring is disposed in the storing section in each of the proposed devices so that individual opening/closing units, after released from their pulling engagement, are contained one by one against the spring resiliency, whereas they are pushed out of the storing section utilizing the repulsive resiliency of the spring. Accordingly, they have to be urged against the resiliency upon containment into the storing section. Further, since the unit is pushed out by a strong resiliency of the spring upon transfer to the track of the opening/closing section, large impact noises are generated and the relevant components are liable to be damaged. Furthermore, it is dangerous as well upon handling.

Japanese Patent Application No. 142486/1986 (not yet laid open to public) filed by the present applicant discloses a structure in which a connection member comprising a single swingeable arm is used both for the slidable engagement and for the pulling engagement between adjacent opening/closing units. However, use of the single member for such double functions in common some time lacks in the smooth movement, particularly, upon transfer from the slidable sideway engagement to the longitudinal engagement under pulling.

SUMMARY OF THE INVENTION

The object of this invention is to provide a support structure used for opening/closing units, capable of slidable sideway engagement and pulling engagement, as well as reducing the interference upon changing the state of the units between the slidable engagement and the pulling engagement and enabling smooth and quiet movement of a plurality of opening/closing units, by disposing sidable engagement members and pulling engagement members of each of support structures for adjacent opening/closing units, independently of and separately from each other.

The above object of this invention can be attained by a support structure including a support main body which is secured to an opening/closing unit and has oblique slidable contact sides each formed in parallel with each other at respective ends of the horizontal plane of the support main body, side engagement members each disposed to one side of the support main body so as to be slidably engageable with an adjacent support main body, and a pulling engagement member integrally secured along one of the oblique slidable contact sides and having an engaging recess and another pulling engagement member disposed to the other of the oblique slidable contact sides at a position inside of a blunt appex so as to be engageable with the engaging recess of one pulling engagement member disposed to an adjacent support structure.

BRIEF DESCRIPTION OF THE ACCOMPANYING DRAWINGS

These and other objects, as well as advantageous features of this invention will become apparent by the following detailed descriptions of the this invention while referring to the accompanying drawings, wherein FIG. 1 is a plan view illustrating a support structure for use in an opening/closing unit unit according to the present invention;

FIG. 2 is an explanatory plan view for the arrangement of rails of a track along which support structures are caused to run under engagement;

FIG. 3*a*is an enlarged cross sectional view taken along line III*a*—III*a* in FIG. 1;

FIG. 3*b* is an enlarged cross sectional view of another embodiment according to this invention corresponding to FIG. 3*a*; and FIG. 4 is an explanatory view illustrating the operation of the support structures according to this invention.

DETAILED DESCRIPTION OF THE INVENTION

Figure 1:
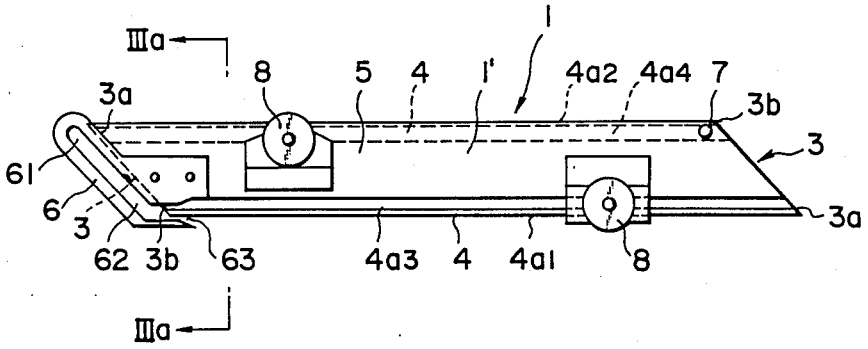

In FIG. 1, a support structure 1 according to this invention is adapted to join the upper side or both of the upper and the lower sides of each of opening and closing units (hereinafter referred to as opening/closing units) I and cause them to run along a track 2 arranged along a predetermined length of a section A to be opened and closed (hereinafter referred to as the opening/closing section A) of a constructed structure for opening and closing such a plurality of series opening/-closing units I, I, — (refer to FIG. 2).

Figure 2:
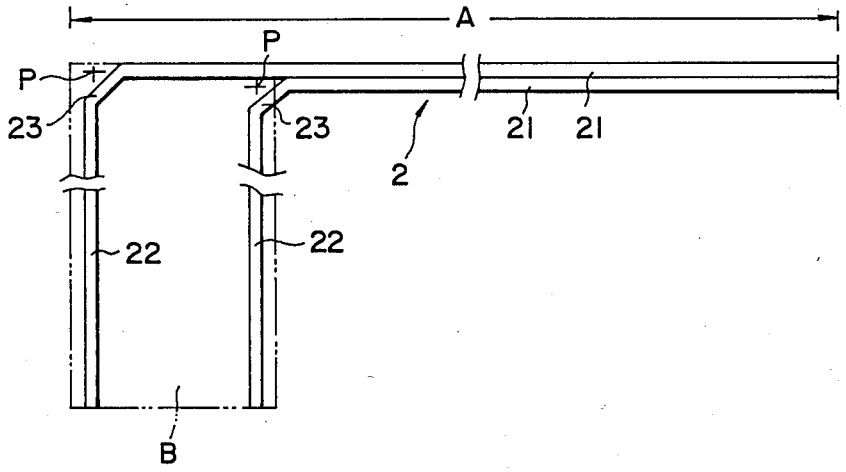

As shown in FIG. 2, the track 2 to which a plurality of series opening/closing units I, I, — are engaged by way of such support structure 2, 2, —, are continuously laid along the opening/closing section A and a section B disposed at one end of the section A in perpendicular thereto for containing the opening/closing units (hereinafter referred to as the storing section B). The respective opening/closing units I, I, — are caused to run in the opening/closing section A in a state where a plurality of adjacent support structure 1, 1, — are connected in series with each other in the longitudinal direction, while the respective opening/closing units I, I — are contained in parallel with each other in the storing portion B in the direction perpendicular to the track of the opening/closing section A.

As shown in FIG. 1, the support structure 1 includes a support main body 1' of a length approximately equal to the longitudinal size of the opening/closing unit I and having a pair of oblique slidable contact sides 3, 3 formed in parallel with each other on the respective longitudinal ends of the horizontal plane of the man body 1'.

The support main body 1' has a pair of side connection members 4, 4 integrally formed to the longitudinal sides thereof respectively so that mating members are engaged in a dove-tail slidable coupling with each other when the support structure 1, 1, — each of an identical shape secured to the adjacent opening/closing unit I, I, — are arranged in parallel with each other.

Figure 3A:
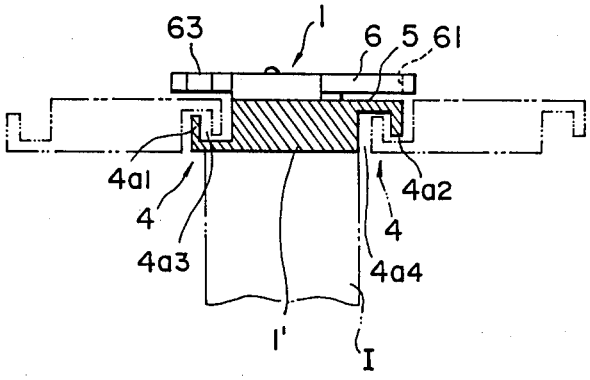

As shown in FIG. 3*a*, the side engagement member 4 comprises a U-cross sectioned upwarded engagement member 4a1 formed to one of the sides of the support main body 1' and an inverted U-cross sectioned downwarded engagement member 4*a*2 formed to the other of the sides thereof, and they are as constituted detailed below. That is, when the support structures 1, 1, 1, — for adjacent opening/closing units I are arranged in parallel with each other as shown in FIG. 3*a*, the upwarded engagement member 4*a*1 on one side of one support structure 1 (central structure depicted by solid lines in the figure) is brought into a dove-tail slidable coupling with the downwarded engagement member 4*a*2 of an adjacent support structure 1 (left structure depicted by phantom lines in the figure), while the downwarded engagement member 4*a*2 on the other side is brought into a dovetail slidable coupling with the upwarded engagement member 4*a*1 of another adjacent support structure 1 (rightward structure depicted by phantom lines in the figure), by which the support structures 1, 1, 1 of adjacent opening/closing units I, I, — (only one unit is illustrated) are embraced with each other and connected slidably in parallel along the engaging grooves 4*a*3, 4*a*4 of the engagement members 4*a*1, 4*a*2.

The dove-tail coupling structure for the side engagement member 4 is not restricted only to that illustrated in FIG. 3*a*.

Figure 3B:
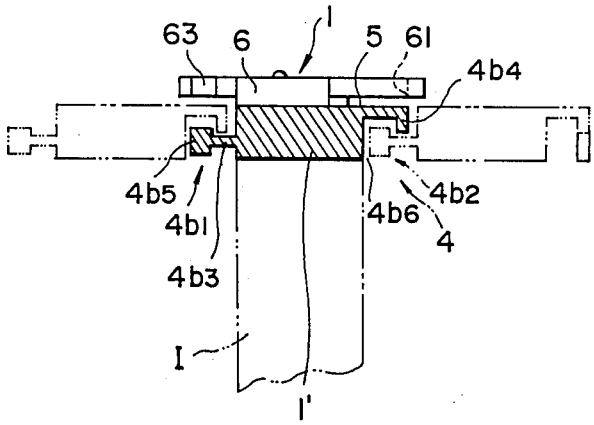

For instance, it may be constituted as shown in FIG. 3*b* in which a male engagement member 4*b*1 formed to one side of a support main body 1' and a female engagement member 4*b*2 formed to the other side of an adjacent main body 1' are engaged with each other in a complimentary manner.

In the modified embodiment shown in FIG. 3*b*, a male engagement member 4*b*1 comprises a neck 4*b*3 and a bulged head 4*b*5 formed to the top end thereof, while female engaging member 4*b*2 complimentary to the male engagement member 4*b*1 comprises a recessed longitudinal edge 4*b*4 that permits the neck 4*b*3 of the female engagement member 4*b*1 to pass therethrough and a longitudinal groove 4*b*6 formed to the inside thereof that freely permits the neck 4*b*5 of the male engagement member 4*b*2 to pass therethrough. Thus, when a plurality of adjacent support structures 1, 1, — are arranged in parallel with each other, the female engagement member 4*b*2 of one support structure 1 and the male engagement member 4*b*1 of another mating support structure 1 are engaged in a dove-tail slidable coupling by the complementary engagement between the groove 4*b*6 and the bulged head 4*b*5 and between the recessed edge 4*b*4 and the neck 4*b*3.

Turning to FIG. 1 again, a female pulling engagement member 6 having an engaging groove or slit 62 is disposed along one of the oblique slidable contact sides 3, 3 each formed in parallel with each other to the ends of the support main body 1'.

The female pulling engagement member 6 comprises a frame having an introduction port 63 for the engaging groove 62 formed in adjacent with a blunt appex 3*b* of the oblique slidable contact side 3 and a terminating end 61 for the engaging groove 62 formed in adjacent with an acute appex 3*a* of the oblique slidable contact side 3. The pulling engagement member 6 is preferably formed integrally to but slightly apart from above the horizontal surface of the support main body 1'.

Figure 4:
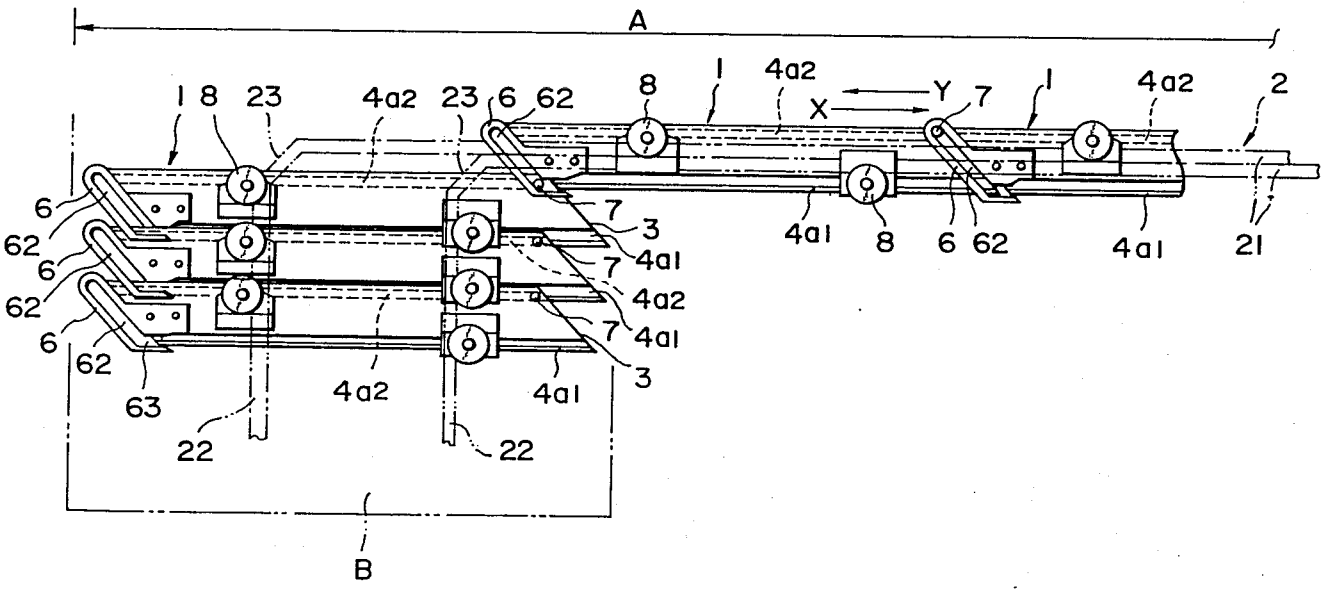

While on the other hand, a male pulling engagement member 7 is disposed on the other of the oblique slidable contact sides 3 of the support main body 1' in adjacent with and inside of a blunt appex 3*b* so as to be engageable with the engaging groove 62 of a female pulling engagement member 6 of an adjacent support main body 1' when a plurality of support structures 1, 1, — are disposed in series with each other (as latter shown in FIG. 4). In the illustrated embodiment, the male pulling engagement member 7 is in the form of a small columnar body and protruded from the surface 5 of the support main body 1' at a position inside of the blunt appex 3*b*.

In the case of engaging and supporting the support structure 1 to the rail track shown in FIG. 2, a pair of runners 8, 8 are preferably secured to the surface 5 of the support main body 1' (FIG. 3*a*) and the support member 1 is engaged by way of the runners 8, 8 to the track 2. In this case, the pair of runners 8, 8 are disposed at such a longitudinal distance in FIG. 1 so that they are aligned with a pair of tracks 22, 22 disposed to the storing section B shown in FIG. 2.

The track 2 for engaging the support structures 1, 1, — comprise rails 21 in the opening/closing section A, rails 22 in the storing section B and an oblique or curved introduction rails 23 constituting the connection portion P for connecting the rails 21 and 22.

Explanation will now be made to the operation of the support structure according to this invention while referring to FIG. 4.

The support structure 1 according to this invention is disposed to the upper side or both of the upper and the lower sides of each of the opening/closing units I, I, — and engaged by way of the runners 8, 8 to the track 2. In this case, each of the support structures 1, 1, — has to be engaged such that the female pulling engagement member 6 having the engaging groove 62 is directed on the track 2 toward the storing section B with the introduction port 63 of the engaging groove 62 being directed toward the storing section B.

The support structure 1 for each of the opening/closing units I, I, — is engaged by way of the runner 8 disposed thereto on the rails 22, 22 in the storing section B. In this case, the support structure 1, 1, — of the adjacent opening/closing units I, I, — are contained in parallel with each other in the storing section B with the side engagement members 3, 3, — being engaged and connected sideways to each other. In this way, the opening/closing units I, I, — are contained by the number required for closing the opening/closing section A in parallel with each other in the storing section B.

Upon pulling out the opening/closing units I, I, — to the opening/closing section A for closure, the first opening/closing unit I is moved along the closing direction X in the opening/closing section A while engaging the support structure 1 thereof on the rails 21. In this case, the last (leftward) support structure 1 on the rails 21 moves in sliding contact with the second support structure 1 that situates uppermost of stationary structures 1, 1, — on the rails 22 in the storing section B by way of slidable engagement between the side engagement members 4, 4 of the first and second support structures 1, 1.

When the first support structure 1 advances rightwardly to a position where it is released or just about to be released from the engagement with the side engagement member 4 of the second structure 1, the male pulling engagement member 7 at the foreend of the succeeding second support structure 1 is caught by the engaging groove 62 of the female pulling engagement member 6 of the preceeding first support structure 1 as shown in FIG. 4. Then as the first support structure 1 runs further along the rails 21 in the opening/closing section A, the succeeding second support structure 1 is hooked to the engaging groove 62 and caused to move toward the rails 21 by way of the oblique rails 23.

Thus, the second support structure 1 is caused to run along the curved rails 23 under sliding contact between the adjacent oblique slidable contact sides 3, 3 of the first and the second support structures and then switched over to the rails 21 in the section A. In this instance, since the respective adjacent units I, I, — in the storing section B are engaged sideways in parallel with each other by means of the side engagement members 4, 4, — the entire support structures 1, 1 — in the storing section B are moved as a group in parallel with each other by way of rails 23 toward the rails 21 in the opening/closing section A on every time each of the support structures 1, 1, — transfers from the rails 22 in the storing section B to the rails 21 in the opening/closing section A.

In this way, the units in the storing section B are successively released to the opening/closing section A to close the section.

In a case where the opening/closing section A is to be opened, any one of the opening/closing units I, I, — supported on the rails 21 is pushed in the direction Y toward the storing section B. Then, the entire serial group of the opening/closing units I, I, — are caused to run interlocking therewith by means of the engagement between the pulling engagement members 6 and 7. Then, the support structure 1 for the preceeding opening/closing unit I pushed out near storing section B is caused to run along the oblique introduction rails 23 between the opening/closing section A and the storing section B to the lower leftward direction in the figure and, at the same time, urged by the support member 1 for the succeeding opening/closing unit I at the rearward oblique slidable contact side 3 to the lower leftward direction in the figure and transfers to the rails 22 in the storing section B. In this state, as shown in FIG. 4, the male pulling engagement member 7 of the preceeding support structure 1 moves to the introduction port 63 in the engaging groove 62 of the female pulling engagement member 6 disposed at one end of the succeeding support structure 1. Accordingly, if the succeeding support structure 1 is further pushed in the same direction Y, the engagement between the pulling engagement members 6 and 7 is released and, at the same time, one engaging member 4a2 of the side connection member 4 (upper side) formed to the support structure 1 for the preceeding opening/closing unit I is engaged with the other engagement member 4a1 of the side connection member 4 (lower side) formed to the support structure 1 for the succeeding opening/closing unit I. As a result, the support structure 1 for the succeeding unit 1 moves to a position opposed to the introduction rails 23 in the storing section B while being in sliding contact with the preceeding support 1 and pushing the support structure 1 of the preceeding unit in parallel to the storing section B.

By repeating such an operation successively and continuously, each of the opening/closing units I, I, — are successively contained in parallel with each other in the storing section B, by which the opening/closing section A is opened.

According to this invention as has been described above, a plurality of support structures 1, 1, — are connected sideways in parallel with each other by the side connection members 4, 4, — to a state contained in parallel in the storing portion B and the sideway movement of the support structure 1, 1, —, i.e., in the direction perpendicular to the longitudinal direction (X, Y) of the structures 1, 1, — is caused exclusively by the function of the side connection members 4, 4,—, whereas the support structures 1, 1, — are connected longitudinally by the pulling engagement members 6, 7, — to each other in a state where they are caused to run in the opening/closing section A and the longitudinal movement of the support members 1, 1, — along the section A, i.e., in the direction (X,Y) is caused exclusively by the function of the pulling engagement members 6, 7—. Further, turning of the moving direction of the support structures 1, 1, — between the sideway direction in the section B and the longitudinal direction in the section A is caused under the sliding contact between the mating oblique slidable contact sides 3, 3 of the adjacent support structures 1, 1. Accordingly, when a plurality of opening/closing I, I, — units supported by such support structures 1, 1, — are caused to run along with the configuration of the track 2 (rails 21, 22, 23), the movement of the support structures 1, 1, —, particularly, the turning movement from the longitudinal direction in the opening/closing section A to the sideway direction in the storing section B and vice versa can be conducted automatically and smoothly since the movement in the respective directions are shared separately and exclusively by the pulling engagement members 6, 7 — and by the side connection members 3, 3 — which are disposed independently and separately. Further, since the turning action is attained by the sliding movement between the mating oblique slidable contact sides 3, 3,—of adjacent support structures 1, 1, — direction of the support members 1, 1, —, and thus that of the opening/closing units I, I, — can be turned quitely and smoothly.

What is claimed is:

1. A support structure for engaging opening and closing units to a track, wherein the support structure (1) comprises:

a support main body (1') which is secured to the upper side or to both of the upper and the lower sides of each of a plurality of opening and closing units that move along a track laid in an opening and closing section (A) of a predetermined length and a storing section (B) contiguous with said section (A), and which has oblique slidable contact sides (3, 3) each formed in parallel with each other at respective ends of a horizontal plane thereof, parallel side engagement members (4, 4) each disposed along a longitudinal side of said support main body respectively for slidably engaging a plurality of adjacent support main bodies to each other when a plurality of main bodies are arranged in parallel with each other, a pulling engagement member (6) integrally secured along one of said oblique slidable contact sides (3, 3) of said support main body (1') and formed with an engaging groove (62) having an introduction port (63) adjacent to a blunt apex (**3*b*) and a terminating end (61) adjacent to an acute apex (3*a*) of one of said oblique slidable contact sides (3, 3) and another pulling engagement member (7) integrally secured to the other of said oblique slidable contact sides (3, 3) of said support main body (1') at a position inside the blunt apex (3*b*), such that said another pulling engagement member (7) is engageable in the engaging groove (62) of said one pulling engagement member (6**) of an adjacent support main body, when a plurality of support main bodies are arranged in series with each other.

2. A support structure as defined in claim 1, wherein a runner (8) to engage to the track is disposed to the surface of the support main body (1').

3. A support structure as defined in claim 2, wherein at least two runners (8, 8) are disposed at such a distance that they are engaged in alignment with a pair of parallel rails (22, 22) of the track in the storing section (B).

* * * * *